US005446522A

United States Patent [19]

Tahara et al.

[11] Patent Number: 5,446,522

[45] Date of Patent: Aug. 29, 1995

[54] IMAGE FORMING APPARATUS FOR FORMING IMAGES IN ACCORDANCE WITH PROCESS STEPS RECEIVED FROM AN EXTERNAL DEVICE

[75] Inventors: Hisatsugu Tahara; Hideki Adachi; Shinichi Nakamura, all of Kawasaki; Naoyuki Ohki; Tokuharu Kaneko, both of Yokohama; Satoshi Kuroyanagi; Hiroshi Ozaki, both of Tokyo; Satoshi Kaneko, Kawasaki; Taisei Fukada, Tokyo; Yukimasa Iseki, Kawasaki; Mitsuhiko Sato, Machida; Mitsuharu Takizawa, Fuchu, all of Japan

[73] Assignee: Canon Kabushiki Kaisha, Tokyo, Japan

[21] Appl. No.: 342,017

[22] Filed: Nov. 16, 1994

Related U.S. Application Data

[63] Continuation of Ser. No. 950,230, Sep. 24, 1992, abandoned.

[30] Foreign Application Priority Data

Sep. 30, 1991 [JP] Japan ..... 3-276108

[51] Int. Cl.[6] ..... G03G 21/00

[52] U.S. Cl. ..... 355/202; 355/204; 355/205; 355/206; 355/208; 395/183.08

[58] Field of Search ..... 355/200, 202, 204, 205, 355/206, 207, 208, 209, 203, 77; 395/500, 575; 371/15.1, 16.4, 29.1

[56] References Cited

U.S. PATENT DOCUMENTS

| | | | |
|---|---|---|---|
| 4,167,322 | 9/1979 | Yano et al. | 355/204 X |
| 4,497,037 | 1/1985 | Kato et al. | 355/202 X |
| 4,583,834 | 4/1986 | Seko et al. . | |
| 4,958,188 | 9/1990 | Miyamoto | 355/206 |
| 5,057,866 | 10/1991 | Hill, Jr. et al. | 355/200 |
| 5,077,582 | 12/1991 | Kravette et al. | 355/206 |
| 5,084,875 | 1/1992 | Weinberger et al. | 371/291 |
| 5,105,229 | 4/1992 | Ozaki | 355/313 |
| 5,214,772 | 5/1993 | Weinberger et al. | 355/202 X |

*Primary Examiner*—A. T. Grimley
*Assistant Examiner*—Sandra L. Brase
*Attorney, Agent, or Firm*—Fitzpatrick, Cella, Harper & Scinto

[57] ABSTRACT

A method of managing an image forming apparatus by a remote computer comprises the steps of detecting an abnormal state in the image forming apparatus, transferring an error code corresponding to the kind of the detected abnormal state to the computer, selecting a predetermined program according to the transferred error code by the computer, transferring the selected predetermined program to the image forming apparatus by the computer, and executing the transferred predetermined program by the image forming apparatus. The predetermined program is a diagnosing program to examine the causes of a failure in the image forming apparatus.

7 Claims, 7 Drawing Sheets

IMAGE FORMING APPARATUS FOR FORMING IMAGES IN ACCORDANCE WITH PROCESS STEPS RECEIVED FROM AN EXTERNAL DEVICE

This application is a continuation of application Ser. No. 07/950,230 filed Sep. 24, 1992, now abandoned.

BACKGROUND OF THE INVENTION

1. Field of the Invention

The invention relates to a program transfer between an image forming apparatus and a host computer to manage the image forming apparatus.

2. Related Background Art

Hitherto, methods whereby a copying apparatus and a host computer at a remote location are connected by a telephone line and various data is transmitted to the host computer and the host computer manages the number of copy sheets and the like have been disclosed in, for instance, U.S. Pat. Nos. 4,583,834, 5,077,582, and 5,084,875, U.S. patent application Ser. Nos. 869,185, 869,182, 868,865, 868,342, and 870,664, and the like.

In the above conventional examples, however, since only data is transmitted and received in the communication with the outside, there are problems such that only the management information such as number of copy sheets, size of copy sheet, and the like of the image forming apparatus can be transmitted to the outside and the like.

On the other hand, if the image forming apparatus side has programs which are not necessary for the ordinary operations of the image forming apparatus, there are inconveniences such that the capacity of a program memory on the image forming apparatus side increases and the processes when the program is changed also become complicated.

SUMMARY OF THE INVENTION

It is an object of the invention to provide a managing method of an image forming apparatus which can solve the above drawbacks.

Another object of the invention is to provide a managing method of an image forming apparatus, in which by enabling a predetermined program which is supplied from the outside to be properly executed, various necessary kinds of programs can be transferred from an external apparatus and can be executed at arbitrary timings.

Still another object of the invention is to provide a managing method of an image forming apparatus, in which a failure diagnosing program is transferred from a service base to the image forming apparatus in which an abnormality has occurred, thereby enabling the necessary repair information or the like to be immediately collected.

Further another object of the invention is to provide a managing method of an image forming apparatus, in which a desired program can be executed without increasing a control burden of an image forming sequence which is executed by control means of the image forming apparatus.

The above and other objects and features of the present invention will become apparent from the following detailed description and the appended claims with reference to the accompanying drawings.

DETAILED DESCRIPTION OF THE PREFERRED EMBODIMENTS

Figure 1:
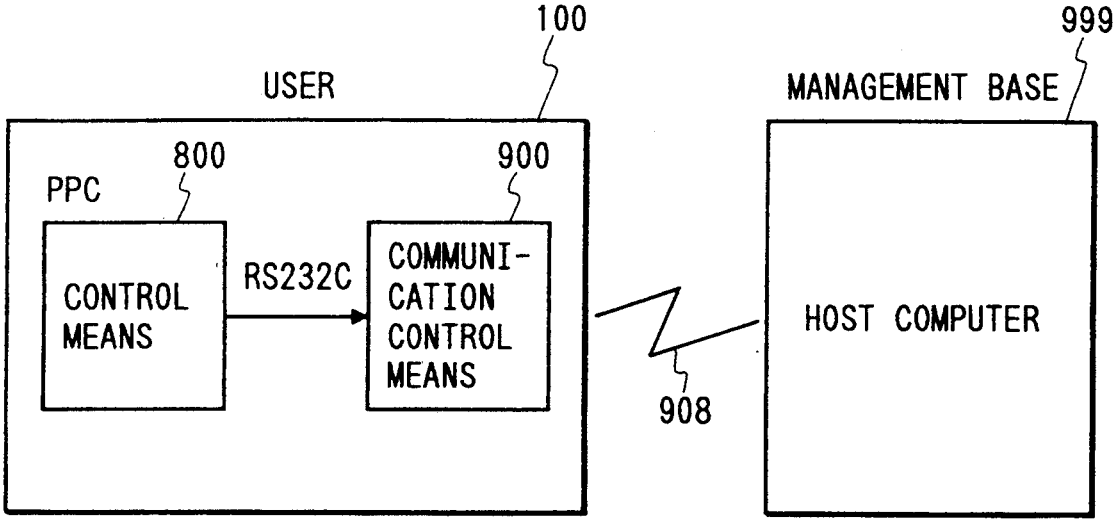
FIG. 1 is a block diagram for explaining a communication construction of an image forming apparatus showing an embodiment of the invention.
Figure 2:
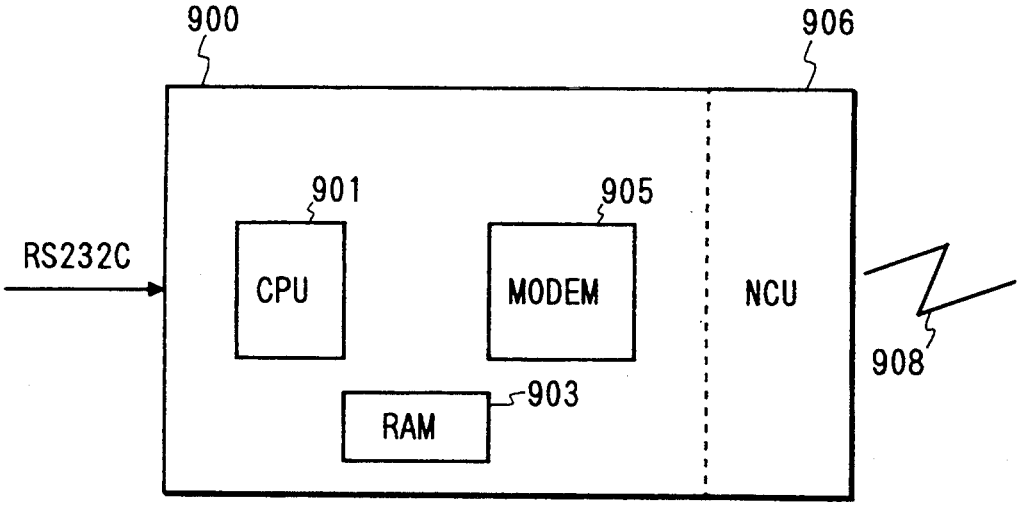
FIG. 2 is a detailed block diagram of a main section for explaining the communication construction of the image forming apparatus showing an embodiment of the invention.

FIGS. 1 and 2 are a block diagram for explaining a communication construction of an image forming apparatus showing an embodiment of the invention and a detailed block diagram of a main section.

In FIG. 1, reference numeral 100 denotes an image forming apparatus main body; 800 control means comprising a CPU, an RAM, an ROM, and the like for controlling the copy operation; 900 communication control means for transmitting and receiving data to/from an external communicating circuit; 908 a public line as an external communicating circuit; and 999 a host computer which is installed at a management base to manage the image forming apparatus main body 100. As shown in FIG. 2, the communication control means 900 comprises: a CPU 901 to perform a communication control; a memory (RAM) 903 to temporarily hold communication data; a modem (modulating-/demodulating apparatus) 905 to generate digital communication data to the public line 908; a network control unit (NCU) 906; and the like.

In the image forming apparatus with the above construction, when the communication control means 900 receives a predetermined program by the communication with the host computer 999, the predetermined program received through interfaces 805 and 907, which will be explained hereinlater, is transferred and stored into an RAM 803, which will be described hereinlater. The control means 800 executes the operation different from the above image forming sequence on the basis of the predetermined program stored in the RAM 803, thereby enabling a predetermined program which is supplied from the outside to be properly executed.

The control means 800 executes the predetermined program which has been transferred and stored in the memory means on the basis of the content of the data that is written into a special address in the RAM 803, thereby enabling an execution timing of the predetermined program which is supplied from the outside to be set.

Further, when the communication control means 900 receives a predetermined program by the communication with an external apparatus, the predetermined program is transferred and stored into the RAM 903 which is provided in the communication control means 900. The communication control means 900 executes the predetermined program stored in the RAM 903, thereby enabling a predetermined program which is supplied from the outside to be properly executed without increasing a burden of the image forming sequence that is executed by the control means 800.

Figure 3:
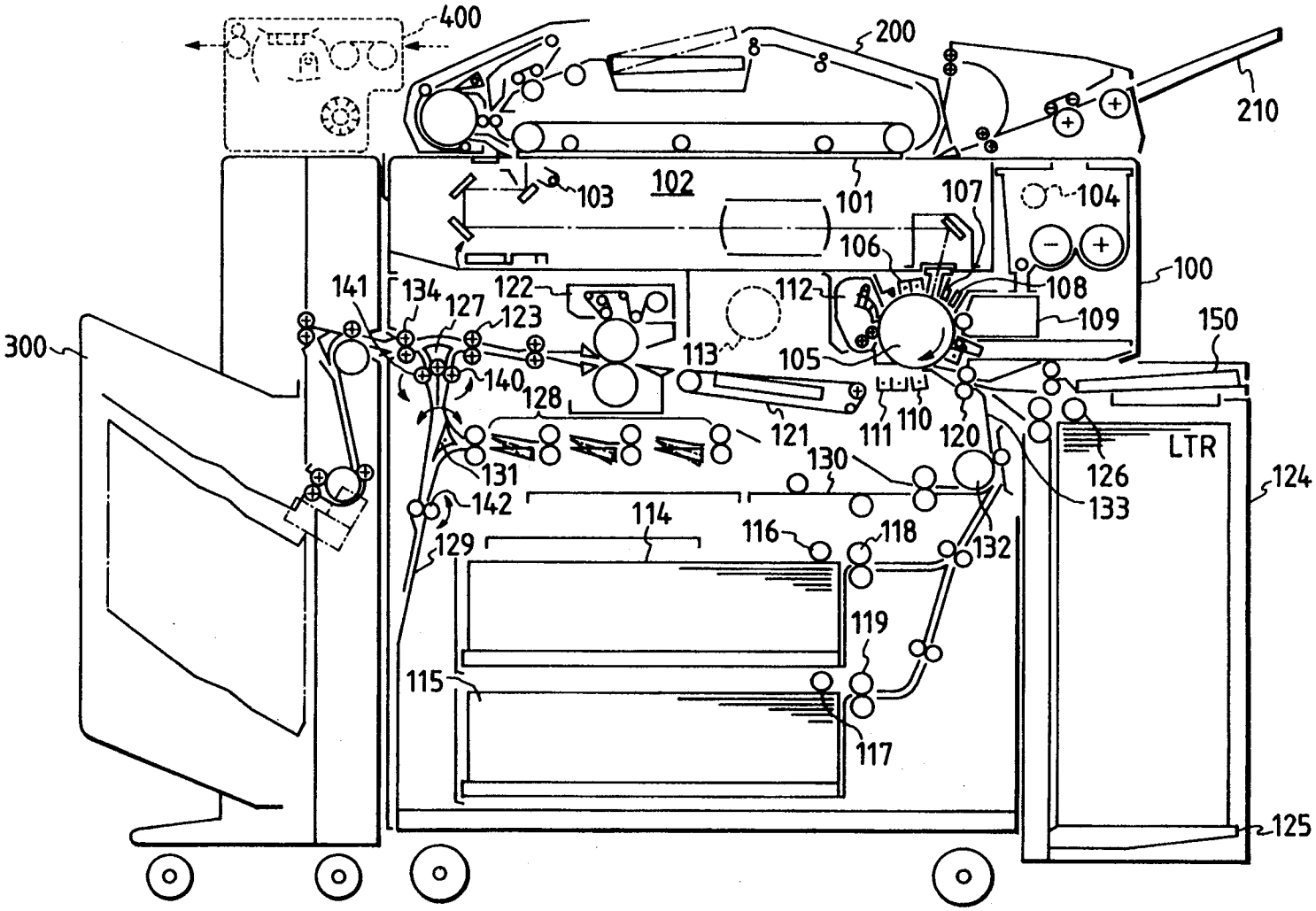
FIG. 3 is a cross sectional view showing a hardware construction of an image forming apparatus main body shown in FIG. 1.

FIG. 3 is a cross sectional view showing a construction of the image forming apparatus main body 100 shown in FIG. 1.

In the diagram, reference numeral 200 denotes a recycling type automatic document feeder (RDF) to automatically feed an original; 300 a sorter to sort the sheets in which the copying process has been finished; and 400 an automatic computer form feeder (CFF). A system can be constructed by freely combining the RDF 200, sorter 300, and CFF 400 to the image forming apparatus main body 100.

In the image forming apparatus main body 100, reference numeral 101 denotes an original base glass as a base plate on which an original is put. Reference numeral 102 denotes an optical system comprising an original illuminating lamp (exposing lamp) 103, a scanning mirror, a lens, a motor 104, and the like. The original is illuminated by the exposing lamp 103 while scanning the original by the motor 104. The reflected light from the original is projected onto a photo sensitive drum 105 by the scanning mirror and the lens.

A high voltage unit 106, a blank exposing unit 107, a potential sensor 108, a developing device 109, a copy transfer charging device 110, a separation charging device 111, a cleaning device 112, and the like are provided around the photo sensitive drum 105. Image recording means is constructed by those components elements.

The photo sensitive drum 105 is rotated by a main motor 113 in the direction indicated by an arrow shown in FIG. 3. The drum 105 has previously been corona charged by the high voltage unit 106. When the reflected light of the original is illuminated from the optical system 102, an electrostatic latent image is formed. The electrostatic latent image is developed by the developing device 109 and is visualized as a toner image. On the other hand, the timing of a copy transfer paper which has been fed into the image forming apparatus main body 100 from an upper cassette 114 or a lower cassette 115 through pickup rollers 116 and 117 by feed rollers 118 and 119 is adjusted by a resist roller 120 so that the front edge of the toner image coincides with the front edge of the copy transfer paper. After that, the paper is fed to the drum 105 and the toner image is transferred onto the surface of the drum 105 by the copy transfer charging device 110. After completion of the copy transfer of the toner image onto the drum, the paper is separated from the drum 105 by the separation charging device 111 and is led to a fixing device 122 by a conveying belt 121. The toner image on the paper is fixed by applying a pressure and a heat to the paper. After that, the paper is discharged to the outside of the image forming apparatus main body 100 by a discharge roller 123. The surface of the drum 105 is cleaned by the cleaning device 112.

A deck 124 which can enclose, for instance, 400 copy transfer sheets is installed into the image forming apparatus main body 100. A lifter 125 of the deck 124 ascends in accordance with a quantity of copy transfer sheets so that the top sheet is always come into contact with a feed roller 126.

In FIG. 3, reference numeral 127 denotes a discharge flapper to switch a conveying path of the copy transfer sheet to either one of the inter-apparatus side or the discharge side (sorter 300). Reference numeral 128 denotes a lower conveying path for turning back the copy transfer sheet sent out from the discharge roller 123 through a reversing path 129 and for leading to a re-feed tray 130. Reference numeral 131 denotes a multiplex flapper for switching the conveying path of the copy transfer sheet in accordance with the both-side recording mode and the multiplex recording mode. By folding down the flapper 131 to the left, the copy transfer sheet is directly led to the lower conveying path 128 without passing through the reversing path 129. Reference numeral 132 denotes a feed roller to feed the copy transfer sheet to the drum 105 side via a path 133. Reference numeral 134 denotes a discharge roller which is arranged near the discharge flapper 127 and discharges the copy transfer sheet which has been switched to the discharge side by the discharge flapper 127 to the outside of the apparatus.

In the both-side recording (both-side copying) mode or the multiplex recording (multiplex copying) mode, the discharge flapper 127 is lifted up, thereby enclosing the copied sheet onto the re-feed tray 130 through the paths 129 and 128 in a state in which the sheet has been turned upside down. In the both-side recording mode, the multiplex flapper 131 is folded down to the right. In the multiplex recording mode, the flapper 131 is folded down to the left. In the back-side recording mode or the multiplex recording mode which is subsequently executed, the copy transfer sheets enclosed on the tray 130 are led one by one from the bottom to the resist roller 120 of the image forming apparatus main body 100 through the path 133 by the feed roller 132.

When the copy transfer sheet is reversed and discharged from the image forming apparatus main body 100, the discharge flapper 127 is lifted up, the multiplex flapper 131 is folded down to the right, and the copied sheet is conveyed to the reversing path 129 side. After the rear edge of the sheet passed through a first feed roller 140, the sheet is conveyed to a second feed roller 141 side by a reversing roller 142 and is folded back by the discharge roller 134 and is discharged to the outside of the apparatus. Reference numeral 150 denotes a multiplex hand-inserting tray and 210 indicates a reservation tray.

Figure 4:
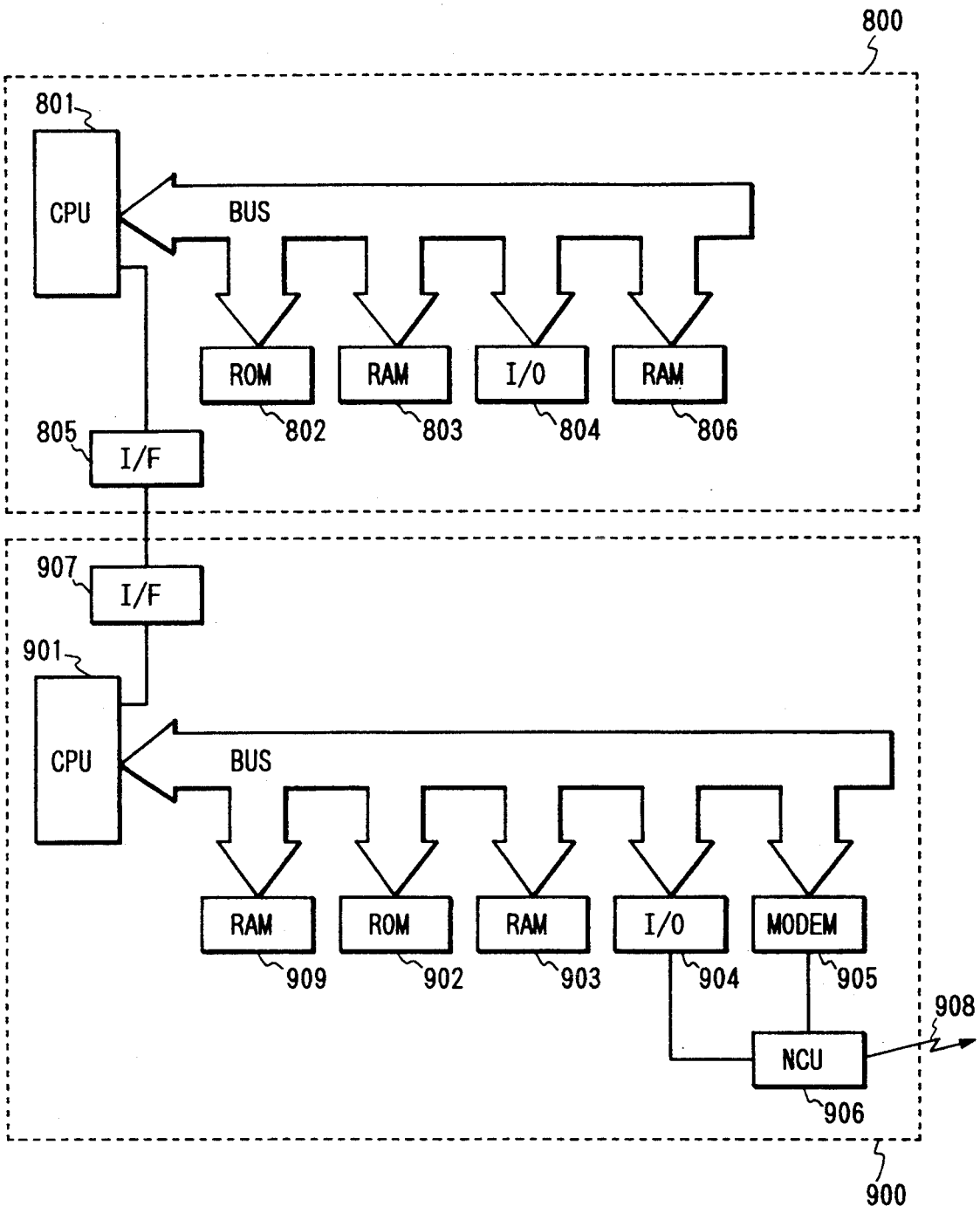
FIG. 4 is a block diagram for explaining a detailed construction of control means and communication control means shown in FIG. 1.

FIG. 4 is a block diagram for explaining a detailed construction of the control means 800 and communication control means 900 shown in FIG. 1.

In the diagram, reference numeral 801 denotes a CPU to control the whole image forming apparatus 100 and 802 indicates a read only memory (ROM) in which a control procedure (control program) of the image forming apparatus main body 100 has been stored. The CPU 801 controls each component element connected through a path in accordance with the control procedure stored in the ROM 802. Reference numeral 803 denotes the random access memory as a main storage device which is used as a memory area of input data, a work memory area, and the like. Reference numeral 804 denotes an input/output port; 805 the interface; and 806 an RAM.

The input/output port 804 receives an output of a control signal of the CPU 801 for a load such as a main motor 113 or the like and a signal of a sensor or the like and supplies to the CPU 801. Reference numeral 900 denotes the communication control means of the public line 908. The communication control means 900 is controlled by the CPU 901. The CPU 901 is connected to the image forming apparatus main body 100 by the interface 907 such as an RC-232C or the like. When a request to transfer data such as total copy sheet number data or the like is generated, if the data is transferred from the image forming apparatus 100 via the interface 907, the transfer data is temporarily held into the RAM 902 provided in the communication control means 900. After completion of the data transfer from the image forming apparatus, the communication line is connected to the outside by controlling the NCU 906, thereby transferring the data to the outside through the modem 905 and NCU 906 after the line was connected. When the data is transferred from the outside, the transfer data is temporarily held into the RAM 903 and the data is transmitted to the image forming apparatus through the interface 907 in response to a request from the image forming apparatus 100. The data here denotes the data stored in the image forming apparatus main body 100. There is a case where a data transfer request is generated when a control abnormality of the image forming apparatus occurs or a paper jam occurs many times or the like on the image forming apparatus main body 100 side, or when a regular reporting time comes. There is also a case where the data request from the external managing side is generated. Reference numeral 904 denotes an input/output port and 909 indicates an RAM.

The control means 800 and the communication control means 900 are connected through the interfaces (transfer means) 805 and 907. The transmission and reception of the control data, total number of copy sheets, jam data, and the like are executed between the control means 800 of the image forming apparatus main body 100 and the communication control means 900 of the public line 908.

Figure 5:
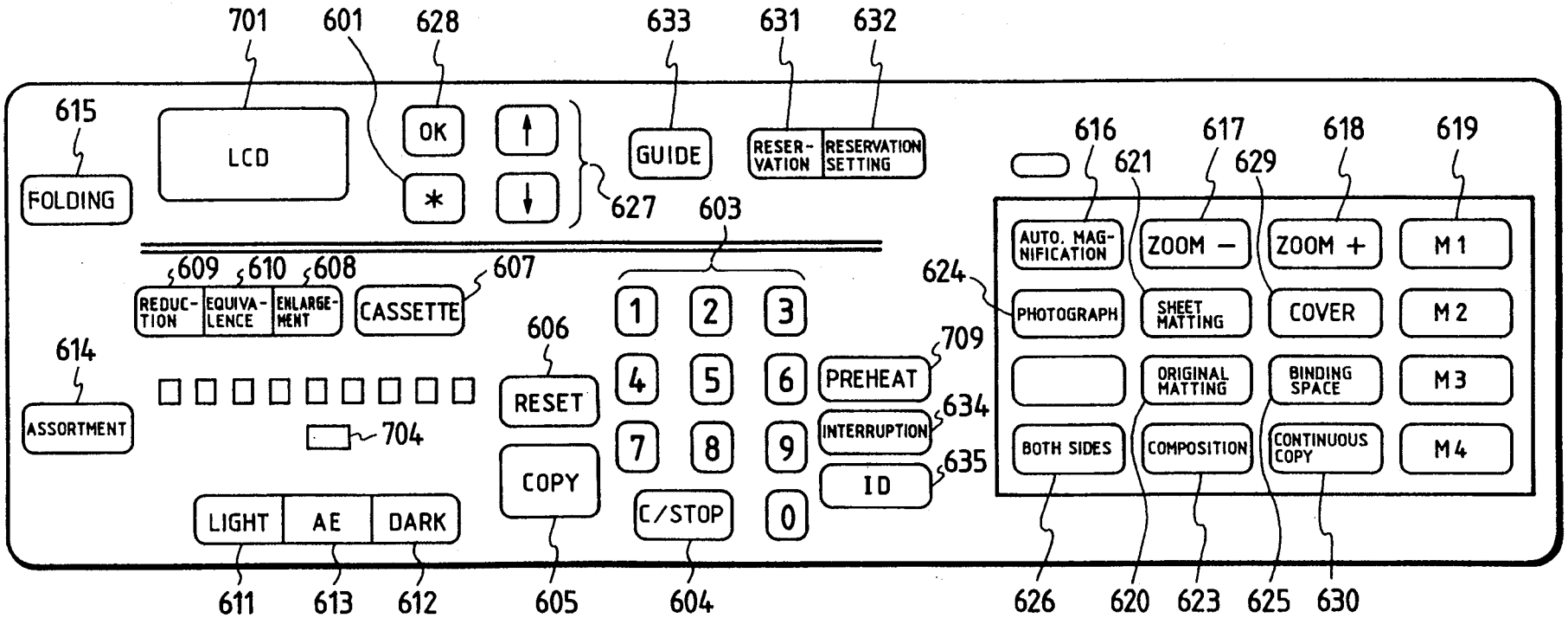
FIG. 5 is a plan view for explaining a construction of an operation unit which is arranged on upper surface of the image forming apparatus main body shown in FIG. 3.

FIG. 5 is a plan view for explaining a construction of an operation unit which is provided on the upper surface of the image forming apparatus main body 100 shown in FIG. 3.

In the diagram, reference numeral 601 denotes an asterisk key. The operator (user) uses the asterisk key 601 in the setting mode to set a binding space amount, an original matting size, or the like. Reference numeral 627 denotes a cursor key which is used to select a set item in the setting mode; 628 an OK key which is used to determine the set content in the setting mode; and 606 an all reset key which is depressed to return the operating mode to the standard mode. The all reset key 606 is also depressed to return the operating mode from the auto shut-off mode to the standard mode. Reference numeral 604 denotes a clear/stop key which functions as a clear key in the standby mode and functions as a stop key during the copy recording operation. The clear/stop key 604 is also used to cancel the set number of copy sheets. The clear/stop key 604 is also depressed to interrupt the continuous copying mode. After the copy operation of the copy sheet at a time point of the depression of the clear/stop key 604 was finished, the copy operation is stopped. Reference numeral 605 denotes a copy key.

Reference numeral 603 denotes a ten-key which is depressed to set the number of copy sheets. The ten-key is also depressed to set the asterisk (*) mode. Reference numeral 619 denotes a memory key. By depressing the memory key, modes which are frequently used by the user can be registered. Four kinds of modes $M_1$ to $M_4$ can be registered in the example. Reference numerals 611 and 612 denote copy density keys which are depressed to manually adjust the copy density; 613 an AE key which is depressed to automatically adjust the copy density in accordance with a density of original or to switch the density adjusting mode to the manual mode by cancelling the AE mode (automatic density adjusting mode); and 607 a copy sheet selection key which is depressed to select either one of the upper cassette 114, lower cassette 115, deck 124, and multiplex hand-inserting tray 150. When the copy sheet selection key 607 is depressed in a state in which the original has been put on the RDF 200, an automatic paper cassette selection (APS) mode is selected and the cassette of the same size as that of the original is automatically selected. Reference numeral 610 denotes an equivalent magnification key which is depressed to obtain the copy of the equal magnification (original size); 616 an auto magnification key which is depressed to automatically designate the reduction or enlargement of the original image in accordance with the designated size of the copy transfer sheet; 626 a both-side key which is depressed to obtain a both-side copy from a one-side original, a both-side copy from a both-side original, or a one-side copy from a both-side original; 625 a binding space key by which a binding space of the designated length can be formed on the left side of the copy transfer sheet; 624 a photograph key which is depressed to copy a photograph original; 623 a composition key which is depressed to form (synthesize) an image onto the same side of the copy transfer sheet from two originals; and 620 an original matting key which is depressed to mat an original of a fixed size by the user. The size of original in this instance is set by the asterisk key 601. Reference numeral 621 denotes a sheet matting key which is depressed to mat the original in accordance with the size of copy sheet and 617 and 618 indicate zoom keys.

Reference numeral 629 denotes a cover mode setting key which is used when a cover paper or a back paper is formed or a binding paper is inserted; 630 a continuous page copy key which is depressed when the left and right pages of a double-spread book are continuously copied; and 614 a discharging method selection key to select a discharging method such as staple port, sort, or group. When a staple sorter is connected, the recorded sheets can be discharged by either one of the staple sorting mode, sorting mode, and group mode which is selected by depressing the discharging method selection key. The selected mode can be cancelled by the key 614. Reference numeral 631 denotes a reservation key which is used to start the setting of the copying mode for a reserved original put on the reservation tray 210 or to cancel the reservation setting; 632 a reservation setting key which is used as a deciding key in the set reserving mode; 633 a guide key which is used to display the descriptions of the functions corresponding to various kinds of keys on a message display 701; and 701 the message display of the LCD (liquid crystal display) type to display the information regarding the copy. For instance, the display 701 displays a character or a figure by a dot pattern of (96×192) dots. That is, the display 701 displays the number of copy sheets set by the ten-key 603, the copy magnification set by fixed size magnification keys 608 and 609, equivalent magnification key 610, and zoom keys 617 and 618, the paper size selected by the copy sheet selection key 607, the message indicative of the state of the image forming apparatus main body 100, the guide message to show an operating procedure, and the set contents of the other various kinds of modes. Reference numeral 704 denotes an AE display which is lit on when the AE (automatic density adjusting) mode is selected by the AE key 613, and 709 indicates a preheat display which is lit on in a preheating mode. When the RDF 200 is used in the standard mode, the number of copy sheets is set to one, the density AE mode is set, the automatic sheet selecting mode is set, the equal magnification is set, and the copy mode to obtain the one-side copy from the one-side original is set. In the standard mode when the RDF 200 is not used, the number of copy sheets is set to one, the manual density setting mode is set, the equal magnification is set, and the copy mode to obtain the one-side copy from the one-side original is set. Whether the RDF 200 is used or not can be known by checking to see if the original has been set in the RDF 200 or not. Reference numeral 615 denotes a folding key, 634 an interruption key, and 635 an ID key.

Figure 6:
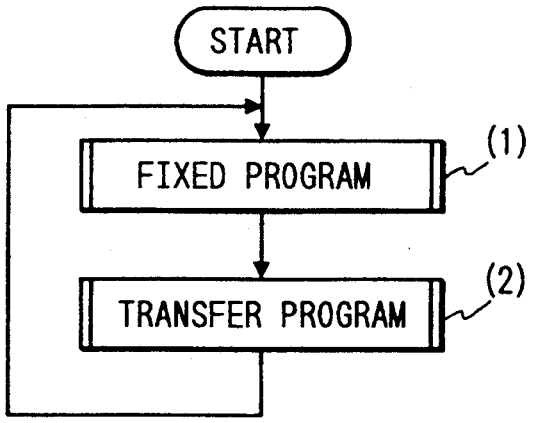
FIG. 6 is a flowchart showing an example of a first control procedure which is executed by a CPU of the control means shown in FIG. 1.

FIG. 6 is a flowchart showing an example of the first control procedure which is executed by the CPU 801 of the control means 800 shown in FIG. 1. Reference numerals (1) and (2) denote processing steps.

The CPU 801 executes a fixed program routine (1). When a transfer program is received, the CPU 801 executes a transfer program routine (2).

Figure 7:
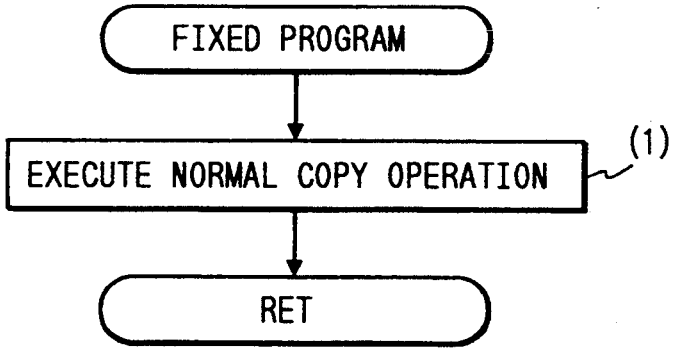
FIG. 7 is a flowchart showing a procedure to execute a fixed program in the image forming apparatus according to the invention.

FIG. 7 is a flowchart showing a fixed program executing procedure in the image forming apparatus regarding the invention. Reference numeral (1) denotes a processing step.

A program for a key input or a display control and a program to perform the copy operation by controlling each load (motor, heater, clutch, or the like) which is necessary to copy are included in the fixed program.

Figure 8:
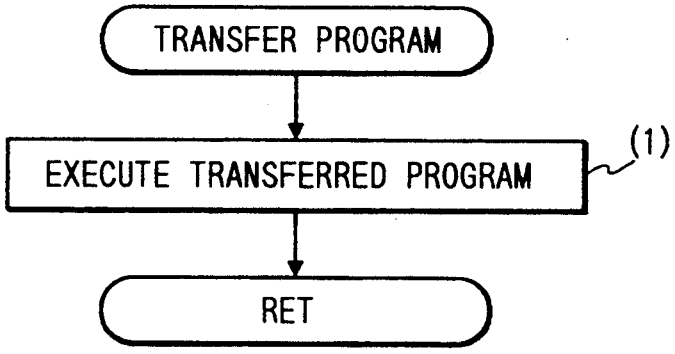
FIG. 8 is a flowchart showing a procedure to execute a transfer program in the image forming apparatus according to the invention.

FIG. 8 is a flowchart showing a transfer program executing procedure in the image forming apparatus according to the invention. Reference numeral (1) denotes a processing step.

The CPU 801 stores the transfer program received through the communication control means 900 into a predetermined area in the RAM 803 and calls the transfer program and executes the transferred program, for instance, a failure diagnosing program transferred from the management base or the like. After that, the processing routine is returned to the main flow.

In general, the fixed program is executed and called the transfer program is called as the subroutine program. However, in the case where no transfer program is transferred and no transfer program is stored in the RAM 803, no process is performed and the processing routine is returned (initial state). However, in the case where the program is sent from the host computer and stored into the RAM 803, the program is executed at any time. When the host computer transmits an erasing command of the transfer program to the CPU 801, the CPU 801 erases the transfer program stored in the RAM 803.

Figure 9:
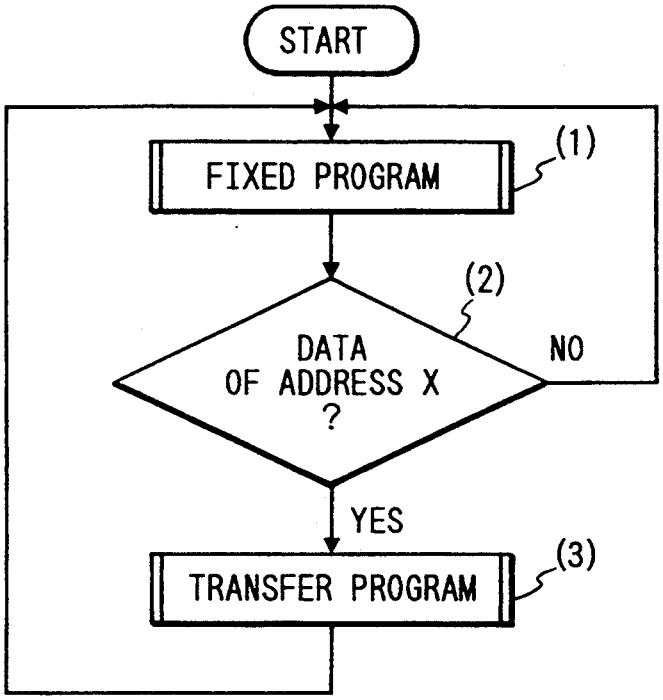
FIG. 9 is a flowchart showing an example of a second control procedure which is executed by the CPU of the control means shown in FIG. 1.

FIG. 9 is a flowchart showing an example of the second control procedure which is executed by the CPU 801 of the control means 800 shown in FIG. 1. Reference numerals (1) to (3) denote processing steps.

First, the program for a key input or a display control or the program to execute the copy operation by controlling each load (motor, heater, clutch, or the like) which is necessary to copy (fixed program) is executed (1). A check is made to see if the data in a certain address X in the RAM 803 is Y or not (2). When the data is Y, the transfer program which has been transferred and stored from the host computer 999 into the RAM 803 is executed (3). The processing routine is subsequently returned to step (1).

When the data is not Y, only the above fixed program is executed without executing the transfer program. Due to this, the CPU 801 can allow the transfer program to be executed at a proper timing.

Figure 10:
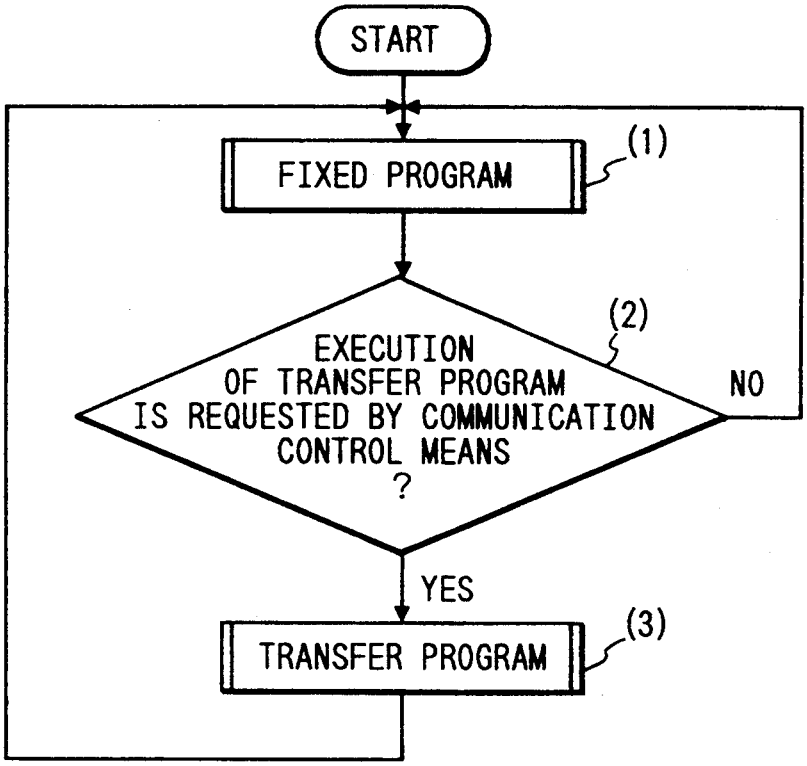
FIG. 10 is a flowchart showing an example of a third control procedure which is executed by the CPU of the control means shown in FIG. 1.

FIG. 10 is a flowchart showing an example of the third control procedure which is executed by the CPU 801 of the control means 800 shown in FIG. 1. Reference numerals (1) to (3) denote processing steps.

First, the program for a key input or a display control or the program to execute the copy operation by controlling each load (motor, heater, clutch, or the like) which is necessary to copy (fixed program) is executed (1). A check is now made to see if a request to execute the transfer program which had been transferred from the host computer 999 to the CPU 801 has been generated from the CPU 901 to perform the communication control or not (2). When there is such a request, the CPU 901 executes the transfer program which has been transmitted from the host computer 999 to the RAM 903 (3). After that, the processing routine is returned to step (1). When the execution request is not generated, only the above fixed program is executed without executing the transfer program. Due to this, the transfer program can be executed without increasing the control burden of the CPU 801 to control the image formation.

Figure 11:
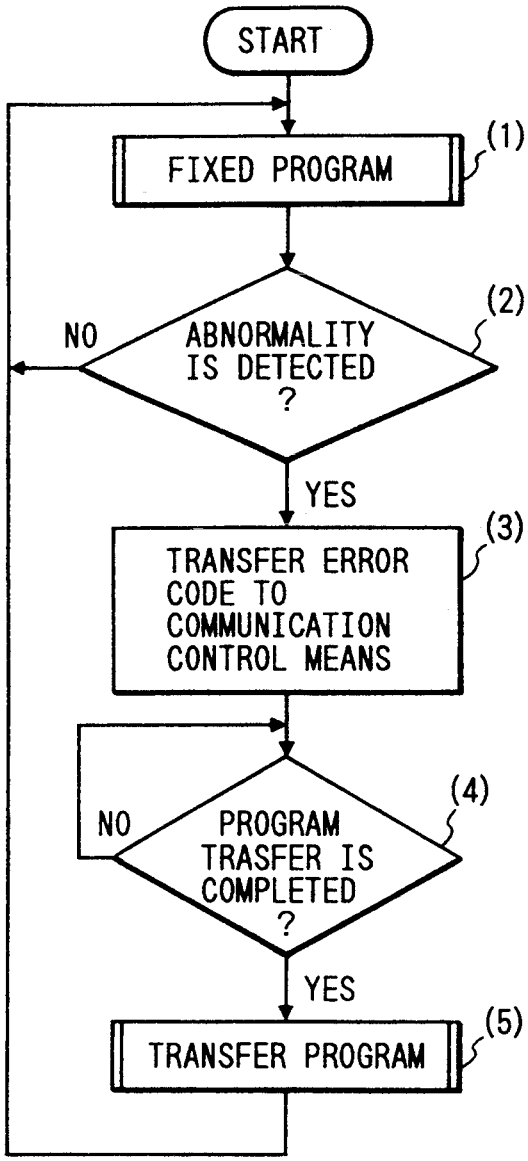
FIG. 11 is a flowchart showing an example of a fourth control procedure which is executed by the CPU of the control means shown in FIG. 1.
Figure 12:
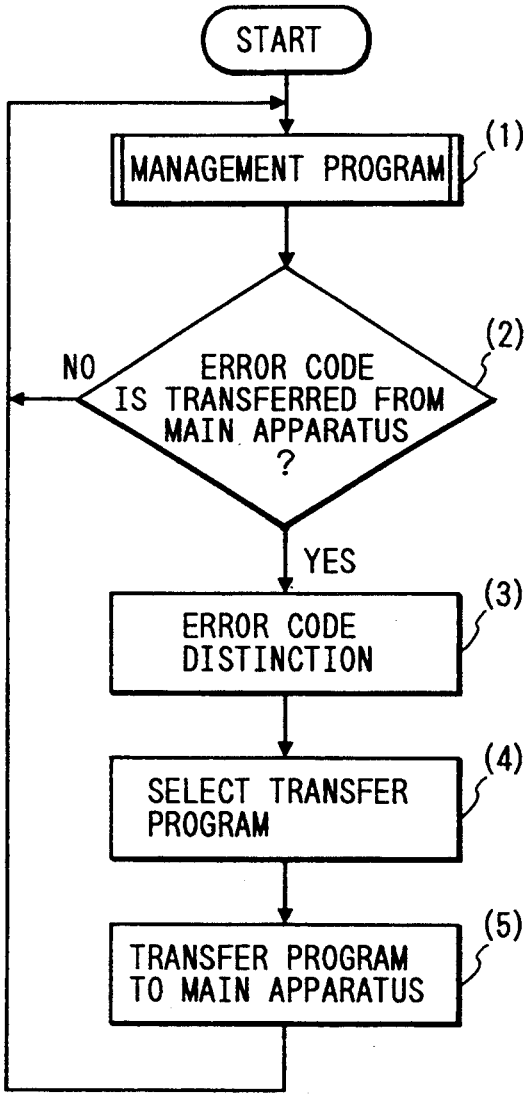
FIG. 12 is a flowchart showing an example of a control procedure of a host computer corresponding to the fourth control procedure.

FIG. 11 is a flowchart showing an example of the fourth control procedure which is executed by the CPU 801 of the control means 800 shown in FIG. 1. FIG. 12 is a flowchart showing an example of a control procedure of the host computer 999.

In FIG. 11, the CPU 801 executes the fixed program (1) as mentioned above and discriminates whether any abnormality has occurred in the image forming apparatus during the execution of the fixed program or not (2). When no abnormality occurs, the fixed program is repetitively executed. When there is an abnormality, an error code to indicate the content of the abnormality is transmitted to the communication control means 900 through the interface 805 (3). The communication control means 900 transmits the error code to the host computer 999 via the public line. After that, the CPU 801 waits until the transfer program is transferred from the host computer 999 through the communication control means 900 (4). After completion of the transfer of the transfer program, the CPU 801 executes the transfer program (5). After completion of the execution of the transfer program, the execution of the fixed program is restarted.

The host computer 999 executes a managing program to perform the management of the number of copy sheets or the like of the image forming apparatus existing at a remote location (1). A check is made to see if the error code has been received from the communication control means during the execution of the managing program or not (2). When the error code is received, the error code is discriminated, thereby recognizing which kind of abnormality has occurred (3). A diagnosing program according to the kind of abnormality recognized is selected from a storage device connected to the host computer 999 (4). The selected diagnosing program is transmitted to the CPU 801 of the image forming apparatus through the communication control means 900 (5).

By transmitting the abnormality detected by the CPU of the image forming apparatus to the host computer as mentioned above, the host computer can transfer the program according to the abnormality to the image forming apparatus.

As a content of the diagnosing program which is transferred to the image forming apparatus, for instance, there is a program to examine more detailed causes of the failure with respect to the detected abnormality, a program to transfer the information necessary for a service person, or a program to execute the image formation without executing the abnormality discriminating step of the failed portion in the case where the image can be formed even if the failed portion is not used.

The present invention is not limited to the foregoing embodiment but many modifications and variations are possible within the spirit and scope of the appended claims of the invention.

What is claimed is:

1. A method of managing an image forming apparatus by a remote computer, comprising the steps of:

detecting an abnormal state in said image forming apparatus;

transferring an error code corresponding to the kind of said detected abnormal state to said remote computer;

selecting by said remote computer a predetermined program different from a normal image forming program corresponding to the transferred error code;

transferring said selected predetermined program from said remote computer to the image forming apparatus;

storing the transferred program into a memory of said image forming apparatus; and executing an operation different from a normal image forming sequence in accordance with the stored predetermined program in the memory of the image forming apparatus.

2. A method according to claim 1, wherein said selecting step includes the step of selecting a diagnostic program, as said predetermined program, to examine a cause of a failure of said image forming apparatus.

3. A method according to claim 1, wherein said selecting step includes the step of selecting an execution program, as said predetermined program, for executing an image forming operation to be executed irrespective of the detected abnormal state.

4. A method according to claim 1, wherein the step of transferring includes the step of communicating between said image forming apparatus and said computer through a communication control apparatus.

5. An image forming apparatus comprising:

image forming means for forming an image onto a recording medium;

image formation control means for controlling an image forming sequence of said image forming means;

detecting means for detecting an abnormal state of said image forming apparatus;

communication means for controlling a communication between the image forming apparatus and a remote computer;

communication control means for causing said communication means to transmit a signal indicative of a type of the abnormal state detected by said detecting means to said remote computer and for causing said communication means to receive a predetermined program different from a normal image forming program transmitted by said remote computer in response to the signal indicative of the type of the abnormal state; and first memory means for storing said predetermined program received by said communication control means, wherein said image formation control means executes operations different from the image forming sequence on the basis of process steps in the predetermined program which has been stored into the first memory means.

6. An apparatus according to claim 5, wherein said image formation control means determines whether the predetermined program which has been stored into the first memory means is executed.

7. An apparatus according to claim 5, further comprising a second memory means for storing a predetermined program received from said remote computer, wherein the communication control means can execute said predetermined program stored in said second memory means in response to an instruction from said image formation control means.

* * * * *